US011577933B2

(12) United States Patent
Chae et al.

(10) Patent No.: US 11,577,933 B2
(45) Date of Patent: Feb. 14, 2023

(54) SYSTEM FOR SUPPORTING EVACUATION STRATEGY USING OCCUPANT EVACUATION ELEVATOR, AND METHOD THEREOF

(71) Applicant: KOREA INSTITUTE OF CIVIL ENGINEERING AND BUILDING TECHNOLOGY, Gyeonggi-Do (KR)

(72) Inventors: Seung Un Chae, Seoul (KR); Bum Yeon Cho, Seoul (KR); Heung Youl Kim, Seoul (KR); Ki Seok Kwon, Gyeonggi-do (KR)

(73) Assignee: KOREA INSTITUTE OF CIVIL ENGINEERING AND BUILDING TECHNOLOGY, Gyeonggi-Do (KR)

( * ) Notice: Subject to any disclaimer, the term of this patent is extended or adjusted under 35 U.S.C. 154(b) by 1120 days.

(21) Appl. No.: 16/198,801

(22) Filed: Nov. 22, 2018

(65) Prior Publication Data

US 2019/0152746 A1 May 23, 2019

(30) Foreign Application Priority Data

Nov. 22, 2017 (KR) ..... 10-2017-0156595

(51) Int. Cl.

| | |
|---|---|
| ***B66B 1/34*** | (2006.01) |
| ***B66B 5/02*** | (2006.01) |
| ***B66B 1/28*** | (2006.01) |

(52) U.S. Cl.

CPC ..... *B66B 5/021* (2013.01); *B66B 1/28* (2013.01); *B66B 1/3423* (2013.01); *B66B 5/024* (2013.01); *B66B 2201/40* (2013.01)

(58) Field of Classification Search

CPC ..... B66B 3/00–006; B66B 5/00–0012; B66B 5/02–024; B66B 2201/243; B66B 2201/403; B66B 2201/405

See application file for complete search history.

(56) References Cited

U.S. PATENT DOCUMENTS

| | | | | |
|---|---|---|---|---|
| 6,000,505 | A | 12/1999 | Allen | |
| 7,594,564 | B2 * | 9/2009 | Siikonen | B66B 5/024 187/290 |

(Continued)

FOREIGN PATENT DOCUMENTS

| | | |
|---|---|---|
| KR | 20070015237 | 2/2007 |
| KR | 100701789 | 3/2007 |

(Continued)

*Primary Examiner* — Christopher Uhlir

(74) *Attorney, Agent, or Firm* — JCIPRNET

(57) ABSTRACT

An evacuation strategy support system using an occupant evacuation elevator (OEE) capable of supporting an evacuation strategy so that information on a number of occupants is recognized by real-time occupant monitoring and thus occupants on each floor may use stairs and the occupant evacuation elevator to safely and quickly evacuate when a disaster situation occurs in a skyscraper and thus the occupants use the occupant evacuation elevator to evacuate, capable of monitoring occupant information on each floor in real time and supporting calculation of an evacuation capacity of the occupant evacuation elevator to establish an evacuation strategy to allow safe evacuation and early reaction in an overall skyscraper to be performed, and capable of optimizing the calculation of the evacuation capacity of the occupant evacuation elevator applicable to an initial stage of a design of the skyscraper, and a method thereof are provided.

10 Claims, 6 Drawing Sheets

(56) References Cited

U.S. PATENT DOCUMENTS

| | | | | |
|---|---|---|---|---|
| 7,849,973 | B2 * | 12/2010 | Hikita | B66B 5/027 187/902 |
| 8,839,914 | B2 * | 9/2014 | Iwata | B66B 5/021 187/387 |

FOREIGN PATENT DOCUMENTS

| | | |
|---|---|---|
| KR | 100968311 | 7/2010 |
| KR | 101223770 | 1/2013 |
| KR | 101245966 | 3/2013 |
| KR | 20170119945 | 10/2017 |

* cited by examiner

SYSTEM FOR SUPPORTING EVACUATION STRATEGY USING OCCUPANT EVACUATION ELEVATOR, AND METHOD THEREOF

CROSS-REFERENCE TO RELATED APPLICATION

This application claims priority to and the benefit of Korean Patent Application No. 2017-0156595, filed on Nov. 22, 2017, the disclosure of which is incorporated herein by reference in its entirety.

BACKGROUND

1. Field of the Invention

The present disclosure relates to an evacuation strategy support system using an occupant evacuation elevator, and more specifically, to an evacuation strategy support system using an occupant evacuation elevator configured to monitor occupant information by floor in real time to support calculation of an evacuation capacity of an occupant evacuation elevator in the case in which occupants evacuate using the occupant evacuation elevator (OEE) when a disaster situation occurs in a skyscraper, and a method thereof.

2. Discussion of Related Art

Generally, an elevator is installed in each of various kinds of high-rise buildings built for residential occupancy, business purposes, and the like for smooth vertical movement of passengers who visit the high-rise buildings.

The elevator is provided with an elevator car configured to move along a hoistway vertically formed in a building in a state in which the passengers ride therein to move the passengers, a motor, a traction machine, an elevator rope, and the like, includes a machine part configured to move the elevator car to a corresponding floor according to a button operation of the passenger, and further includes an elevator controller configured to control the machine part according to the button operation of the passenger so that the elevator car operates to the corresponding floor.

Generally, the elevator is not used in the high-rise building when a disaster situation such as fire or the like occurs. However, an elevator is globally used for evacuation in a skyscraper after a case in which many people use an elevator to quickly evacuate to an evacuation safe area when a disaster situation occurs. An elevator in which safety measures are relatively improved in comparison with a general passenger elevator to be used for evacuation in the skyscraper like the above refers to an occupant evacuation elevator (OEE).

Specifically, at least one passenger elevator in the skyscraper should be installed to be suitable to an installation standard of the occupant evacuation elevator, and in this case, a pressurization smoke control system which is configured to prevent smoke introduction when fire occurs should be installed in the occupant evacuation elevator, and an emergency power should be supplied even when a blackout occurs using an emergency power generator.

Meanwhile, FIG. 1 is a view illustrating an installation concept of an occupant evacuation elevator in a general high-rise building.

As shown in FIG. 1, an occupant evacuation elevator 12 can select the most suitable method among a method of using a general passenger elevator 11 by improving the performance of the general passenger elevator 11, a method of using an emergency elevator 13, and a method of separately installing the occupant evacuation elevator 12 in consideration of safety, suitability of an operating purpose, and economic feasibility. An operating purpose of the occupant evacuation elevator 12 is provided so that occupants directly use an elevator to evacuate to an evacuation safe area separately from a purpose for saving the occupants due to an extinguishing act of a fire department.

First, a usage of the emergency elevator 13 used for purposes of evacuation and the extinguishing act is to be used for evacuation of the occupants at an initial state of fire and to be used for the extinguishing act after the fire department arrives. Since confusion can increase when the occupants cannot use the emergency elevator after waiting to evacuate, and evacuation and extinguishment usages have clearly different usage purposes and methods, use of the emergency elevator 13 as the occupant evacuation elevator 12 is illogical.

Further, the method of separately installing the occupant evacuation elevator 12 in the high-rise building is efficient for safety and maintenance, but since the number of installations is limited in comparison with the general passenger elevator 11, and a separate installation area and a countermeasure against uselessness of equipment are required, the method of separately installing the occupant evacuation elevator 12 is illogical like the above.

On the other hand, the method of using the general passenger elevator 11 as the occupant evacuation elevator 12 by improving the performance of the general passenger elevator 11 is economical because idleness of equipment is prevented and a separate installation of the elevator is not required, and the method is efficient because a homing instinct of a person is considered. However, since using the general passenger elevator 11 as the occupant evacuation elevator 12 in the skyscraper can confuse people, an accurate promotion of the above is necessary, and thorough maintenance and training are necessary so that the general passenger elevator 11 is smoothly used as the occupant evacuation elevator 12.

Hereinafter, the occupant evacuation elevator 12 in the specification can be described as an elevator manufactured to be ordinarily used for passengers but which can be used for evacuation when a disaster such as fire or the like occurs. That is, the occupant evacuation elevator 12 refers to an elevator which is not additionally installed separately from the passenger elevator 11 like the emergency elevator 13, but an elevator having an evacuation function among the passenger elevators 11, and at least one passenger elevator in a high-rise building 10 is installed to be suitable to the installation standard of the occupant evacuation elevator 12. Specifically, the installation standard of the occupant evacuation elevator 12 is defined to be divided into an occupant evacuation elevator platform structure, an occupant evacuation elevator hoistway structure, an occupant evacuation elevator machine room structure, a standby power for the occupant evacuation elevator, and the like.

Meanwhile, in a case of a skyscraper which is a building greater than or equal to 200 m or greater than or equal to 50 floors, the occupant evacuation elevator is linked with an evacuation safe floor (or evacuation safe area) to be installed, but apparent regulations or technologies for an evacuation capacity of the occupant evacuation elevator are not disclosed.

In an initial stage of a design of the skyscraper, although calculation of the evacuation capacity for installing the occupant evacuation elevator in response to the disaster situation is verified using simple numerical calculation or evacuation simulation, the method takes a great deal of time during the initial stage of the design of the skyscraper, and particularly, when the design of the skyscraper is changed, a great deal of time can be spent reviewing.

Further, since there is a lack of accurate occupant information in the building when the disaster situation occurs in the skyscraper, thus making it difficult to establish an evacuation strategy, the evacuation capacity of the occupant evacuation elevator should be quickly calculated during the initial stage of the design of the skyscraper.

PRIOR ART DOCUMENT

Patent Document (Patent Document 0001) Korean Patent Application No. 10-1245966 (application date: Jan. 18, 2010), title of the disclosure: "elevator system".

(Patent Document 0002) Korean Patent Application No. 10-1223770 (application date: Nov. 18, 2010), title of the disclosure: "elevator strategy support system".

(Patent Document 0003) Korean Patent Application No. 10-968311 (application date: Mar. 25, 2008), title of the disclosure: "managing apparatus of elevator at evacuation".

(Patent Document 0004) Korean Patent Application No. 10-701789 (application date: Dec. 15, 2006), title of the disclosure: "driving system of lifesaving elevator of skyscraper".

(Patent Document 0005) Korean Laid-open Patent No. 2017-119945 (laid open date: Oct. 30, 2017), title of the disclosure: "fire evacuation apparatus for high-rise building".

(Patent Document 0006) Korean Laid-open Patent No. 2007-15237 (laid open date: Feb. 1, 2007), title of the disclosure: "driving apparatus of high-rise building fire extinguishing and lifesaving elevator".

SUMMARY OF THE INVENTION

The present disclosure is directed to an evacuation strategy support system using an occupant evacuation elevator configured to monitor occupant information by floor in real time to support calculation of an evacuation capacity of an occupant evacuation elevator in the case in which occupants evacuate using the occupant evacuation elevator (OEE) when a disaster situation occurs in a skyscraper, and a method thereof.

The present disclosure is directed to an evacuation strategy support system using an occupant evacuation elevator configured to optimize calculation of an evacuation capacity of an occupant evacuation elevator for an initial design of a skyscraper, and a method thereof.

An evacuation strategy support system using an occupant evacuation elevator according to the present disclosure when occupants use an occupant evacuation elevator to evacuate in a disaster situation in a skyscraper includes an occupant monitoring part configured to collect occupant information on a number of occupants on each floor of the skyscraper to store the occupant information on the number of occupants on each floor in a database, configured to calculate density of the occupants of each floor to perform grouping, and configured to analyze a number of accommodable people and an area of each evacuation safe area to determine whether the evacuation safe area is sufficient so that all the grouped occupants evacuate; an occupant evacuation elevator specification analyzing part configured to analyze and input a specification of the occupant evacuation elevator when the grouped occupants are accommodable in the evacuation safe area; an evacuation capacity calculating part configured to calculate an operating time of the occupant evacuation elevator of each evacuation safe area and determine whether the occupant evacuation elevator is operable to review an overload of an evacuation capacity at each evacuation safe area, and whether a readjustment and a redesign are necessary, and configured to determine whether an evacuation capacity according to a selection of an evacuation path of the grouped occupants is distributable to calculate a final evacuation capacity of the occupant evacuation elevator; and an occupant evacuation information providing part linked with a real-time distributed control system to provide occupant evacuation information corresponding to the calculated evacuation capacity of the occupant evacuation elevator, wherein the evacuation capacity calculating part optimizes evacuation capacity calculation of the occupant evacuation elevator applicable to an initial stage of a design of the skyscraper.

The evacuation strategy support system using an occupant evacuation elevator may further include a database configured to store the occupant information on the number of occupants collected from the occupant monitoring part and configured to store occupant evacuation elevator specification data, operating time data according to a general operation method, National Fire Protection Association (NFPA) data, and experiment data.

Here, the specification of the occupant evacuation elevator may include an elevator capacity, a number of operable elevators, and an operating velocity, which are specifications related to an operation of the occupant evacuation elevator. The occupant evacuation elevator specification analyzing part may review and input an operation method of the occupant evacuation elevator.

Here, the occupant monitoring part may include a part for collecting information on the number of occupants of each floor configured to collect the occupant information on the number of occupants on each floor of the skyscraper to store the occupant information on the number of occupants on each floor in the database; a part for analyzing the density of occupants of each floor configured to calculate density, which is a number of people per area of the occupants of each floor, and to perform grouping so that the density of the occupants corresponds to the number of accommodable people at an evacuation safe floor; an evacuation safe area analyzing part configured to analyze the number of accommodable people and the area of each evacuation safe area; and an evacuation safe area accommodation determining part configured to determine whether the evacuation safe area is sufficient so that all the grouped occupants evacuate.

Here, the evacuation capacity calculating part may include an occupant evacuation elevator operation determining part configured to calculate the operating time of the occupant evacuation elevator of each evacuation safe area and determine whether the occupant evacuation elevator is operable, an evacuation capacity review part of each evacuation safe area configured to review the overload of the evacuation capacity at each evacuation safe area and whether the readjustment and the redesign are necessary when the occupant evacuation elevator is operable, an evacuation capacity distribution determining part configured to determine whether the evacuation capacity according to the selection of the evacuation path of the grouped occupants is distributable, and a final evacuation capacity calculating part configured to calculate the final evacuation capacity of the occupant evacuation elevator.

Here, the real-time distributed control system may selectively extract a disaster/catastrophe situation and corresponding information on the skyscraper to quickly share to a location at which information is necessary as a cyber-physical system (CPS) linked with the evacuation capacity calculating part to provide evacuation situation information.

Meanwhile, an evacuation strategy support method using an occupant evacuation elevator according to the present disclosure when occupants use an occupant evacuation elevator to evacuate in a disaster situation which occurs in a skyscraper includes a) collecting occupant information on the number of occupants on each floor of a skyscraper and storing the occupant information on the number of occupants on each floor in a database; b) calculating density of the occupants of each floor to perform grouping; c) analyzing the number of accommodable people and an area of each evacuation safe area; d) determining whether the evacuation safe area is sufficient so that all the grouped occupants evacuate; e) analyzing and inputting a specification of the occupant evacuation elevator when the grouped occupants are accommodable in the evacuation safe area; f) determining whether the occupant evacuation elevator of each evacuation safe area is operable; g) reviewing overload of an evacuation capacity at each evacuation safe area and whether readjustment and redesign are necessary when the occupant evacuation elevator is operable; h) determining whether an evacuation capacity according to selection of an evacuation path of the grouped occupants is distributable; i) calculating a final evacuation capacity of the occupant evacuation elevator; and j) providing occupant evacuation information linked with a real-time distributed control system to correspond to the calculated evacuation capacity of the occupant evacuation elevator, wherein evacuation capacity calculation of the occupant evacuation elevator applicable to an initial stage of a design of the skyscraper is optimized.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
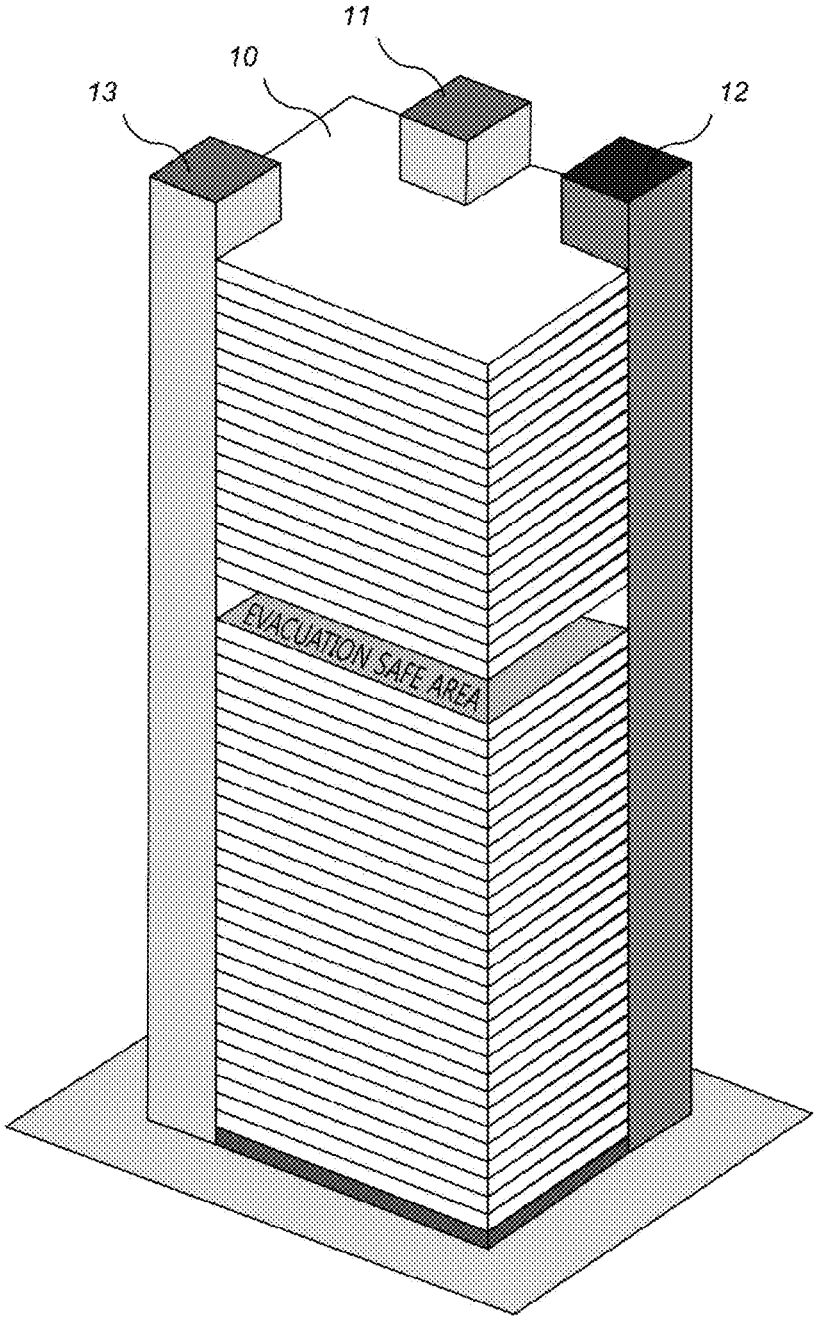
FIG. 1 is a view illustrating an installation concept of an occupant evacuation elevator in a general high-rise building.

Hereinafter, embodiments of the present disclosure will be described in detail with reference to the accompanying drawings which may allow one of ordinary skill in the art to easily perform the present disclosure. The present disclosure may be implemented in various forms and is not limited to the following embodiments. Further, components not related to the description are omitted in the drawings to clearly describe the present disclosure, and similar reference symbols are used for similar components in the description.

In the entire description, a case in which one part "includes" one component is not meant to preclude other components but to further include other components unless specifically stated otherwise. Further, terms such as " . . . part" and the like disclosed in the description mean units which process at least one function or operation and the above may be implemented in hardware or software, or implemented in coupling of hardware and software.

Figure 2:
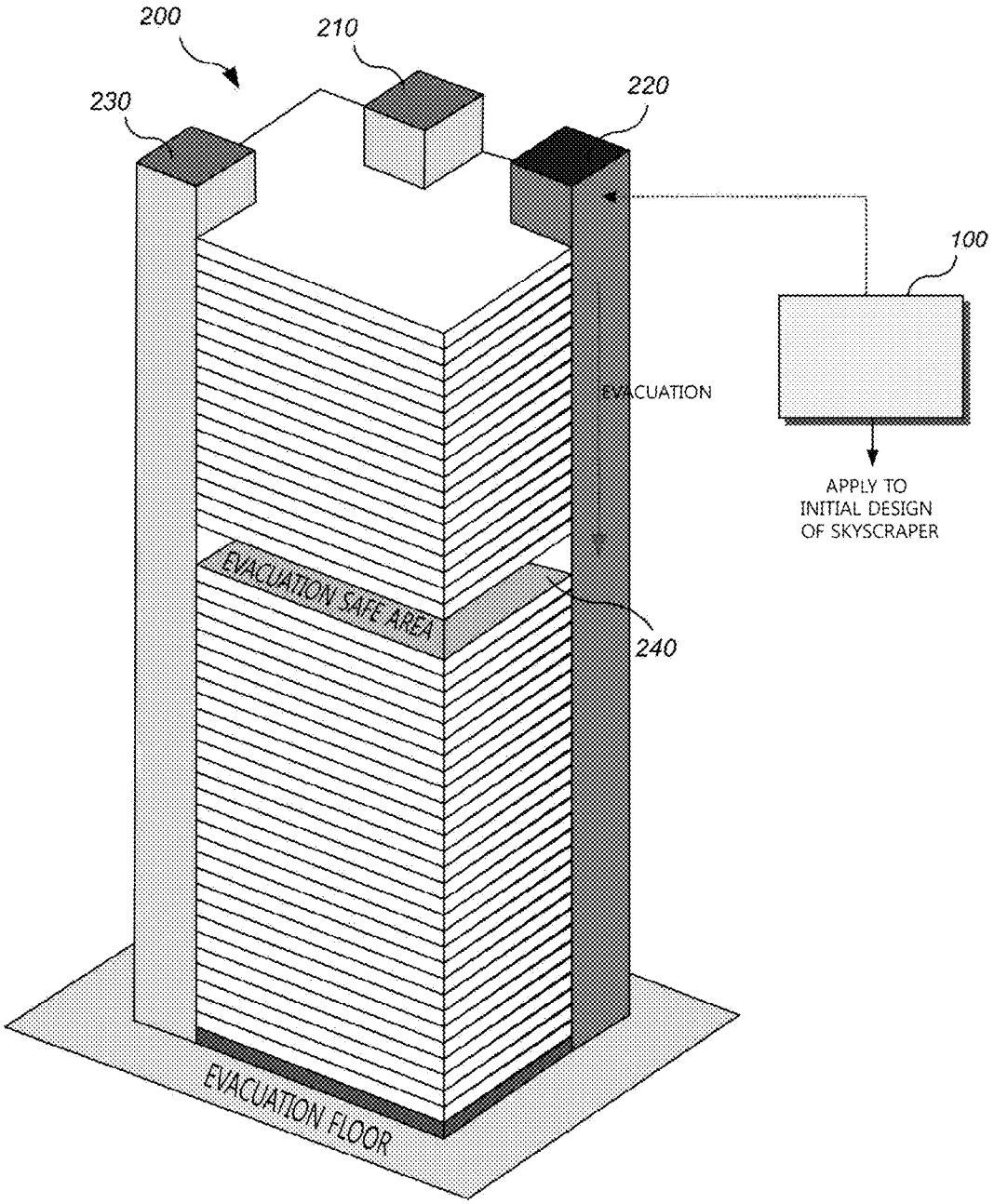
FIG. 2 is a view illustrating a concept of an evacuation strategy support system using an occupant evacuation elevator according to an embodiment of the present disclosure.

An Evacuation Strategy Support System 100 Using an Occupant Evacuation Elevator FIG. 2 is a view illustrating a concept of an evacuation strategy support system using an occupant evacuation elevator according to an embodiment of the present disclosure.

As shown in FIG. 2, an evacuation strategy support system 100 using an occupant evacuation elevator according to the embodiment of the present disclosure may support an evacuation strategy so that occupants on each floor may safely and quickly evacuate using stairs and an occupant evacuation elevator 220 when a disaster situation occurs in a skyscraper 200 in which a passenger elevator 210, the occupant evacuation elevator 220, and an emergency elevator 230 are installed.

The evacuation strategy support system 100 using an occupant evacuation elevator according to the embodiment of the present disclosure may monitor occupant information of each floor in real time and support calculation of an evacuation capacity of the occupant evacuation elevator to establish the evacuation strategy of the skyscraper 200 so that all the occupants may safely evacuate and may perform an early reaction, and further, the calculation of the evacuation capacity of the occupant evacuation elevator 220 may be optimized to be applicable to an initial stage of a design of the skyscraper 200.

Figure 3:
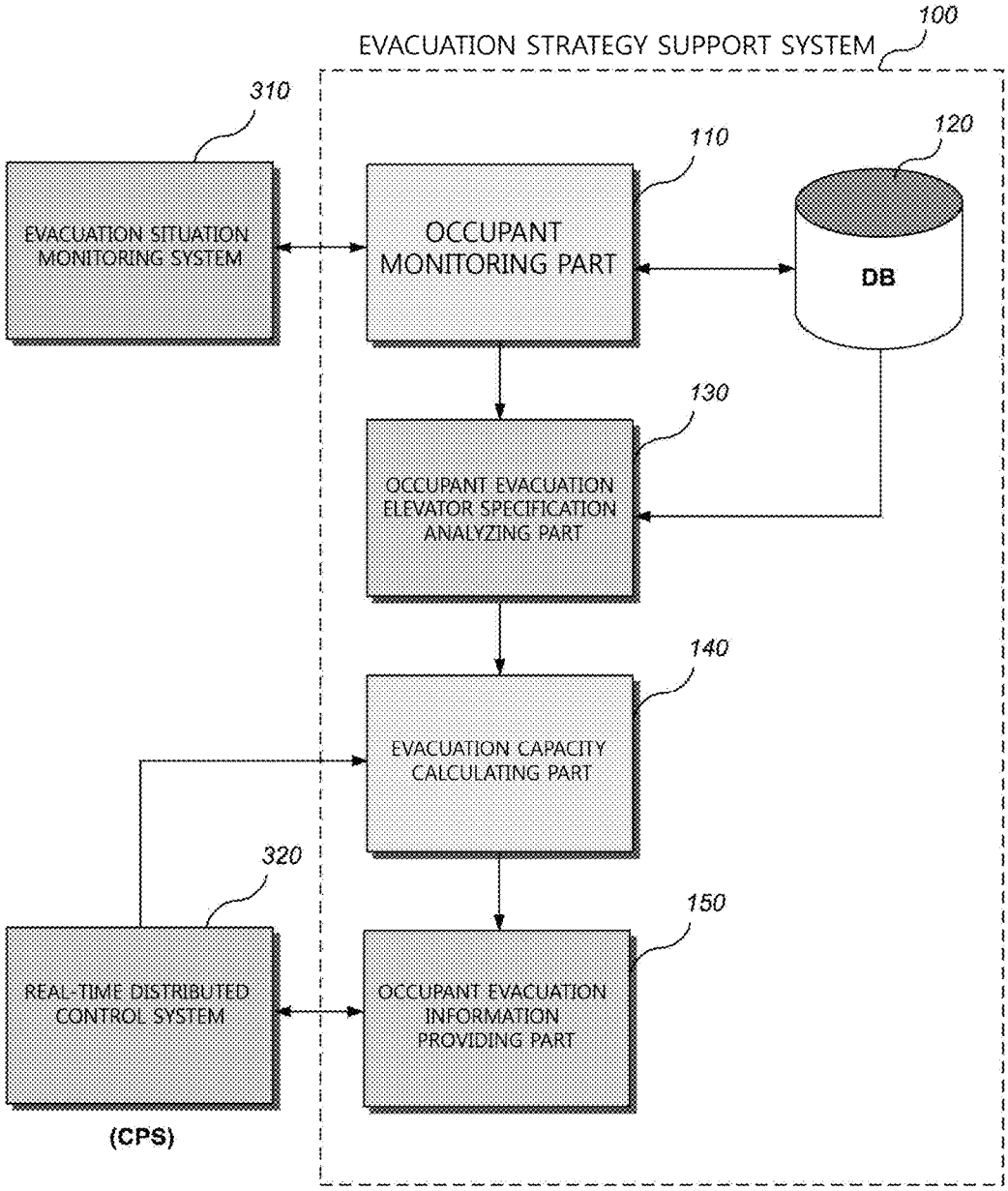
FIG. 3 is a schematic block diagram of the evacuation strategy support system using an occupant evacuation elevator according to the embodiment of the present disclosure.

Meanwhile, FIG. 3 is a schematic block diagram of the evacuation strategy support system using an occupant evacuation elevator according to the embodiment of the present disclosure.

Referring to FIG. 3, the evacuation strategy support system 100 using an occupant evacuation elevator according to the embodiment of the present disclosure includes an occupant monitoring part 110, a database 120, an occupant evacuation elevator specification analyzing part 130, an evacuation capacity calculating part 140, and an occupant evacuation information providing part 150.

The occupant monitoring part 110 collects occupant information on a number of occupants on each floor of the skyscraper 200 to store the occupant information on the number of occupants on each floor in the database 120, calculates density of the occupants of each floor to perform grouping, and analyzes a number of accommodable people and an area of each evacuation safe area 240 to determine whether the evacuation safe area 240 is sufficient so that all the grouped occupants may evacuate. Meanwhile, an evacuation situation monitoring system 310 built separately from the evacuation strategy support system 100 using an occupant evacuation elevator according to the embodiment of the present disclosure may monitor an evacuation situation according to the real-time occupant information on the number of occupants collected from the occupant monitoring part 110.

The database 120 stores the occupant information on the number of occupants collected from the occupant monitoring part 110, and stores occupant evacuation elevator specification data, operating time data according to a general operation method, National Fire Protection Association (NEPA) data, and experiment data.

The occupant evacuation elevator specification analyzing part 130 analyzes and inputs a specification of the occupant evacuation elevator 220 when the grouped occupants are accommodable in the evacuation safe area 240. Here, the specification of the occupant evacuation elevator 220 includes an elevator capacity, a number of operable elevators, and an operating velocity, which are specifications related to an operation of the occupant evacuation elevator, and reviews and inputs an operation method of the occupant evacuation elevator.

The evacuation capacity calculating part 140 calculates an operating time of the occupant evacuation elevator 220 of each evacuation safe area and determines whether the occupant evacuation elevator 220 is operable to review an overload of an evacuation capacity at each evacuation safe area 240, whether a readjustment and a redesign are necessary, and determines whether an evacuation capacity according to a selection of an evacuation path of the grouped occupants is distributable to calculate a final evacuation capacity of the occupant evacuation elevator 220.

The occupant evacuation information providing part 150 is linked with a real-time distributed control system 320 to provide occupant evacuation information corresponding to the calculated evacuation capacity of the occupant evacuation elevator 220. Here, the real-time distributed control system 320 may be a cyber physical system (CPS), and the evacuation capacity calculating part 140 may be linked with the CPS 320 to provide evacuation situation information. In other words, as the real-time distributed control system 320, a disaster/catastrophe corresponding integrated CPS, which may selectively extract disaster/catastrophe situations and corresponding information of the skyscraper and complex and may quickly share with a site at which information is necessary, may be built. In this case, the CPS refers to a real-time distributed control system configured to directly connect things to the Internet and thereby collect, analyze, and control data.

Figure 4:
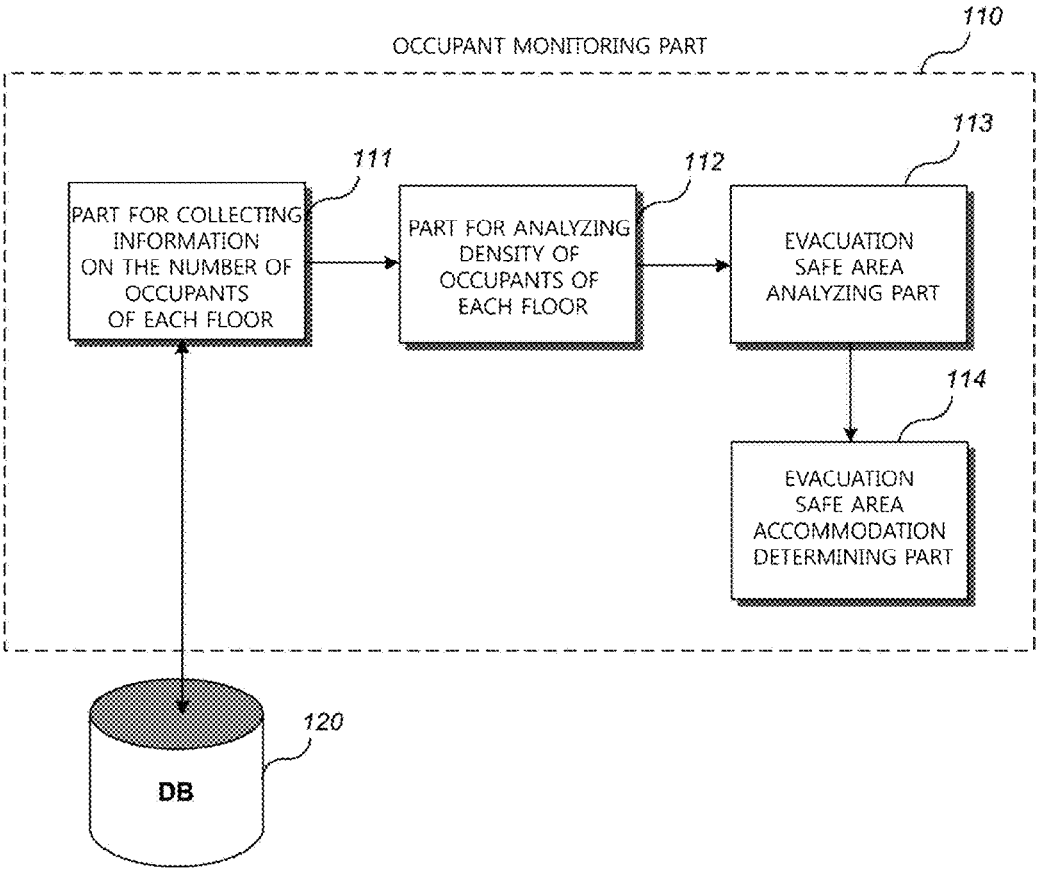
FIG. 4 is a specific block diagram of an occupant monitoring part in the evacuation strategy support system using an occupant evacuation elevator according to the embodiment of the present disclosure.

Meanwhile, FIG. 4 is a specific block diagram of an occupant monitoring part in the evacuation strategy support system using an occupant evacuation elevator according to the embodiment of the present disclosure.

Referring to FIG. 4, in the evacuation strategy support system using an occupant evacuation elevator according to the embodiment of the present disclosure, the occupant monitoring part 110 includes a part for collecting information on the number of occupants of each floor 111, a part for analyzing the density of occupants of each floor 112, an evacuation safe area analyzing part 113, and an evacuation safe area accommodation determining part 114.

The part for collecting information on the number of occupants of each floor 111 of the occupant monitoring part 110 collects the occupant information on the number of occupants on each floor of the skyscraper 200 to store the occupant information on the number of occupants on each floor in the database 120. In this case, the evacuation situation monitoring system 310 may monitor the evacuation situation according to the collected occupant information on the number of occupants.

The part for analyzing the density of occupants of each floor 112 calculates the density of the occupants of each floor to perform grouping. That is, the part for analyzing the density of occupants of each floor 112 calculates density, which is the number of people per area of the occupants of each floor, and performs the grouping so that the density of the occupants corresponds to the number of accommodable people at an evacuation safe floor 240.

The evacuation safe area analyzing part 113 analyzes the number of accommodable people and an area of each evacuation safe area 240.

The evacuation safe area accommodation determining part 114 determines whether the evacuation safe area 240 is sufficient so that all the grouped occupants may evacuate. Accordingly, when the evacuation safe area 240 is not sufficient, it is determined that the number of all grouped occupants exceeds the number of accommodable people and the area of each evacuation safe area 240. Further, when the evacuation safe area 240 may accommodate the grouped occupants, the specification of the occupant evacuation elevator 220 is analyzed and input.

Figure 5:
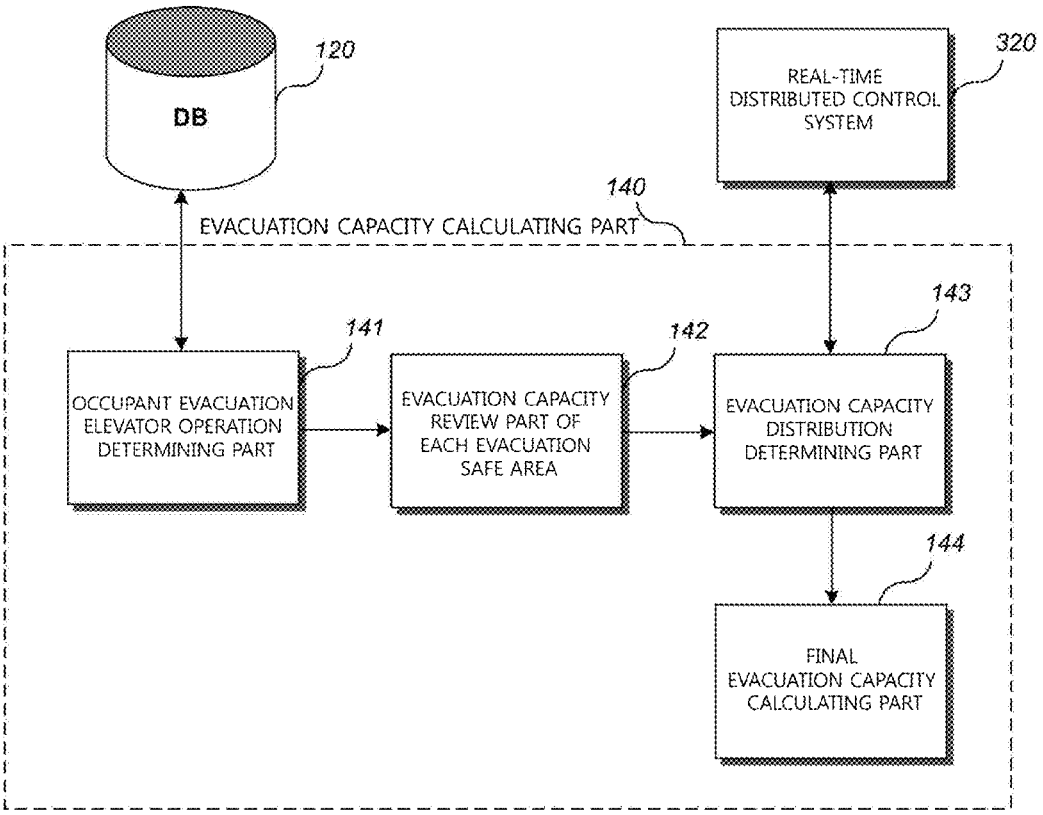
FIG. 5 is a specific block diagram of an evacuation capacity calculating part in the evacuation strategy support system using an occupant evacuation elevator according to the embodiment of the present disclosure.

Meanwhile, FIG. 5 is a specific block diagram of an evacuation capacity calculating part in the evacuation strategy support system using an occupant evacuation elevator according to the embodiment of the present disclosure.

Referring to FIG. 5, in the evacuation strategy support system using an occupant evacuation elevator according to the embodiment of the present disclosure, the evacuation capacity calculating part 140 includes an occupant evacuation elevator operation determining part 141, an evacuation capacity review part of each evacuation safe area 142, an evacuation capacity distribution determining part 143, and a final evacuation capacity calculating part 144.

The occupant evacuation elevator operation determining part 141 calculates an operating time of the occupant evacuation elevator 220 of each evacuation safe area to determine whether the occupant evacuation elevator 220 is operable.

The evacuation capacity part of each evacuation safe area 142 reviews the overload of the evacuation capacity at each evacuation safe area 240 and whether the readjustment and the redesign of the evacuation capacity at each evacuation safe area 240 are necessary when the occupant evacuation elevator 220 is operable.

The evacuation capacity distribution determining part 143 determines whether the evacuation capacity according to the selection of the evacuation path of the grouped occupants is distributable.

The final evacuation capacity calculating part 144 calculates a final evacuation capacity of the occupant evacuation elevator 220.

Ultimately, in a case of the evacuation strategy support system using an occupant evacuation elevator according to the embodiment of the present disclosure, when information for recognizing the number of occupants, such as real-time occupant monitoring, is provided, the evacuation capacity may be calculated on the basis of necessary regulations and technical methods, and accordingly, the evacuation strategy may be quickly established.

In the case of the evacuation strategy support system using an occupant evacuation elevator according to the embodiment of the present disclosure, when the disaster situation occurs in the skyscraper and thus the occupants evacuate using the occupant evacuation elevator (OBE), the evacuation strategy may be supported by recognizing the information on the number of occupants through the real-time occupant monitoring so that the occupants on each floor may use the stairs and the occupant evacuation elevator to safely and quickly evacuate.

Further, in the case of the evacuation strategy support system using an occupant evacuation elevator according to the embodiment of the present disclosure, the evacuation strategy may be established by monitoring occupant information in real time and supporting the calculation of the evacuation capacity of the occupant evacuation elevator to allow safe evacuation and early reaction in an overall skyscraper to be performed, and further, the calculation of the evacuation capacity of the occupant evacuation elevator applicable to the initial stage of the design of the skyscraper may be optimized.

An Evacuation Strategy Support Method Using an Occupant Evacuation Elevator

Figure 6:
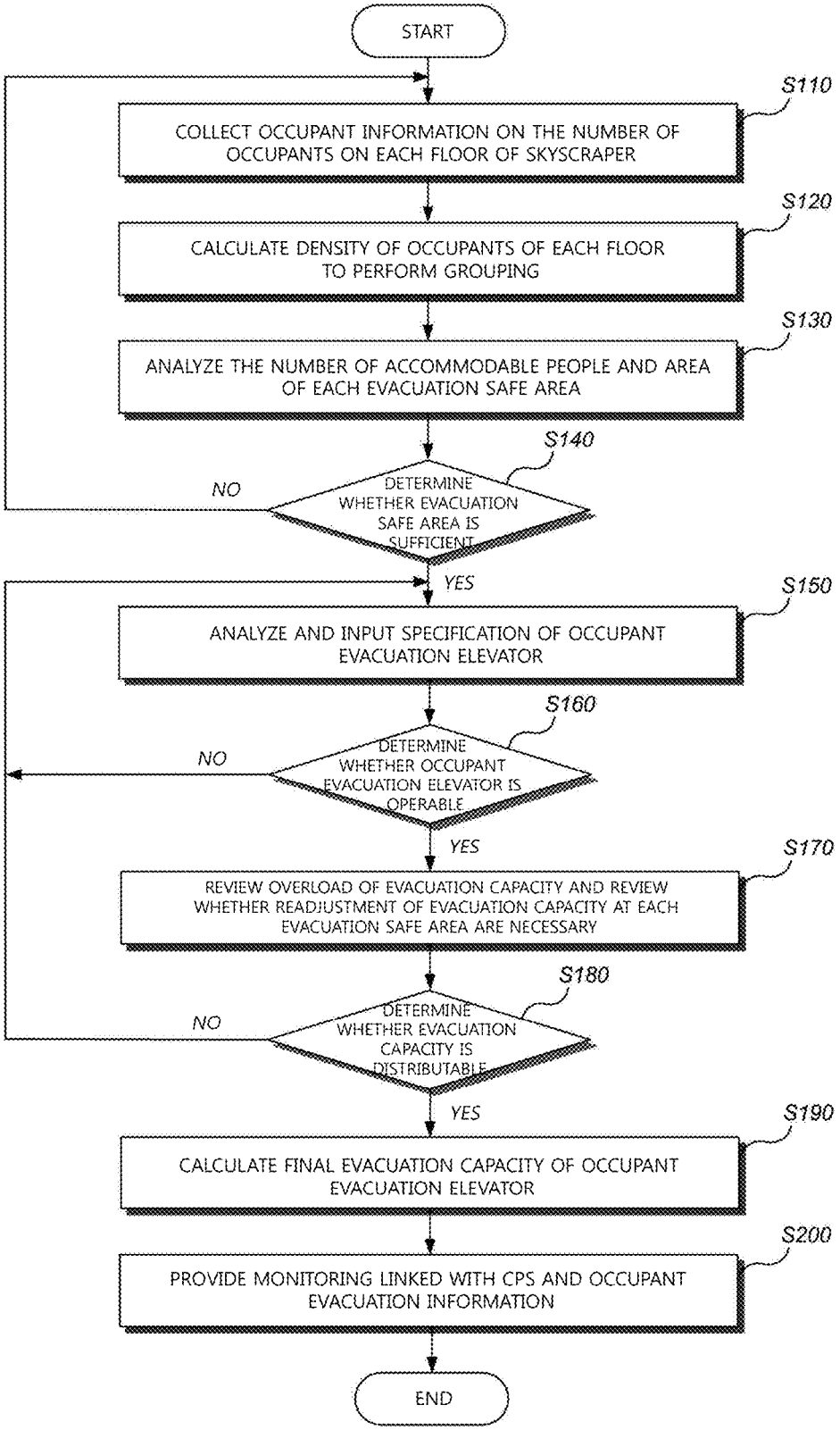
FIG. 6 is a flow chart of an evacuation strategy support method using an occupant evacuation elevator according to the embodiment of the present disclosure.

FIG. 6 is a flow chart of an evacuation strategy support method using an occupant evacuation elevator according to the embodiment of the present disclosure.

Referring to FIG. 6, the evacuation strategy support method using an occupant evacuation elevator according to the embodiment of the present disclosure includes collecting the occupant information on the number of occupants on each floor of the skyscraper 200 and storing the occupant information on the number of occupants on each floor in the database 120 (S110) in the case in which the occupants uses the occupant evacuation elevator to evacuate when the disaster situation occurs in the skyscraper 200. In this case, the evacuation situation monitoring system 310 may monitor the evacuation situation according to the collected occupant information on the number of occupants on each floor.

Further, the density of the occupants of each floor is calculated to perform grouping (S120). That is, density, which is the number of people per area of each floor, is calculated, and the grouping is performed so that the density of the occupants corresponds to the number of accommodable people at an evacuation safe floor 240.

Next, the number of accommodable people and the area of each evacuation safe area 240 are analyzed (S130).

In addition, whether the evacuation safe area 240 is sufficient so that all the grouped occupants may evacuate is determined (S140).

In addition, the specification of the occupant evacuation elevator 220 is analyzed and input when the grouped occupants are accommodable in the evacuation safe area 240 (S150). Here, the specification of the occupant evacuation elevator 220 may include the elevator capacity, the number of operable elevators, and the operating velocity, which are the specifications related to the operation of the occupant evacuation elevator operation, and in this case, the operation method of the occupant evacuation elevator may be reviewed to be input. When the evacuation safe area 240 is not sufficient, it is determined that the number of all grouped occupants exceeds the number of accommodable people and the area of each evacuation safe area 240.

Further, whether the occupant evacuation elevator 220 of each evacuation safe area 240 is operable is determined (S160). That is, the operating time of the occupant evacuation elevator 220 is calculated to determine whether the occupant evacuation elevator 220 is operable.

Further, the overload of the evacuation capacity at each evacuation safe area 240 and whether the readjustment and the redesign of the evacuation capacity at each evacuation safe area 240 are necessary are reviewed when the occupant evacuation elevator 220 is operable (S170).

In addition, whether the evacuation capacity according to the selection of the evacuation path of the grouped occupants is distributable is determined (S180).

In addition, when the evacuation capacity is distributable, the final evacuation capacity of the occupant evacuation elevator is calculated (S190). When the evacuation capacity is not distributable, the operation returns to the above described operation analyzing and inputting the specification of the occupant evacuation elevator 220.

Further, the occupant evacuation information linked with the real-time distributed control system 320 to correspond to the calculated evacuation capacity of the occupant evacuation elevator 220 is provided (S200).

Ultimately, according to the embodiment of the present disclosure, the evacuation strategy support method using an occupant evacuation elevator may be used to verify the evacuation capacity of the occupant evacuation elevator at the initial stage of the design of the skyscraper and may be used to predict all evacuation times according to the number of occupants in the building after the skyscraper is completely built. Further, the evacuation strategy support method using an occupant evacuation elevator may be used for optimum evacuation to predict all time spent for the evacuation using the occupant evacuation elevator when the disaster situation occurs in the skyscraper and may be used to check the evacuation situation through the real-time monitoring and establish the evacuation strategy when the disaster situation occurs in the skyscraper.

According to the present disclosure, an evacuation strategy can be supported so that information on the number of occupants is recognized by real-time occupant monitoring and thus occupants on each floor can use stairs and an occupant evacuation elevator to safely and quickly evacuate when a disaster situation occurs in a skyscraper when the occupants use the occupant evacuation elevator to evacuate.

According to the present disclosure, an evacuation strategy can be established by monitoring occupant information in real time and supporting calculation of an evacuation capacity of the occupant evacuation elevator to allow safe evacuation and early reaction in an overall skyscraper to be performed.

According to the present disclosure, the calculation of the evacuation capacity of the occupant evacuation elevator applicable to an initial stage of a design of the skyscraper can be optimized.

The above-described descriptions of the present disclosure are exemplary, and those skilled in the art of the present disclosure may understand that the present disclosure may be embodied in other specific forms without changing the technical spirit or essential characteristics. Accordingly, the above-described embodiments should be understood to be exemplary and not limiting. For example, each component described as a single entity may be distributed and implemented, and components described as being dispersed may be implemented in an integrated form.

The scope of the present disclosure is shown by the claims rather than the detailed description, and all variations or different forms derived from the means, scope, and equivalents of the claims should be interpreted to be included in the scope of the present disclosure.

What is claimed is:

1. An evacuation strategy support system using an occupant evacuation elevator (OEE) to evacuate in a disaster situation in a skyscraper, comprising:

an occupant monitoring part configured to collect occupant information on a number of the occupants on each floor of the skyscraper to store the occupant information on the number of occupants on each floor in a database, configured to calculate density of the occupants of each floor to perform grouping, and configured to analyze a number of accommodable people and an area of an evacuation safe area to determine whether the evacuation safe area is sufficient so that all the grouped occupants evacuate;

an occupant evacuation elevator specification analyzing part configured to analyze and input a specification of the occupant evacuation elevator in response to the grouped occupants being accommodable in the evacuation safe area;

an evacuation capacity calculating part configured to calculate an operating time of the occupant evacuation elevator of the evacuation safe area and determine whether the occupant evacuation elevator is operable; the evacuation capacity calculating part further configured to review an overload of an evacuation capacity at the evacuation safe area and whether a readjustment and a redesign are necessary, and configured to determine whether the evacuation capacity according to a selection of an evacuation path of the grouped occupants is distributable to calculate a final evacuation capacity of the occupant evacuation elevator; and an occupant evacuation information providing part linked with a real-time distributed control system to provide occupant evacuation information corresponding to the calculated evacuation capacity of the occupant evacuation elevator, wherein the evacuation capacity calculating part optimizes evacuation capacity calculation of the occupant evacuation elevator applicable to an initial stage of a design of the skyscraper.

2. The evacuation strategy support system using the occupant evacuation elevator of claim 1, further comprising a database configured to store the occupant information on the number of occupants collected from the occupant monitoring part, and configured to store occupant evacuation elevator specification data, operating time data according to a general operation method, and National Fire Protection Association (NEPA) data.

3. The evacuation strategy support system using the occupant evacuation elevator of claim 1, wherein:

the specification of the occupant evacuation elevator includes an elevator capacity, a number of operable elevators, and an operating velocity, which are specifications related to an operation of the occupant evacuation elevator; and the occupant evacuation elevator specification analyzing part reviews and inputs an operation method of the occupant evacuation elevator.

4. The evacuation strategy support system using the occupant evacuation elevator of claim 1, wherein the occupant monitoring part includes:

a part for collecting information on the number of occupants of each floor configured to collect the occupant information on the number of occupants on each floor of the skyscraper to store the occupant information on the number of occupants on each floor in the database;

a part for analyzing the density of occupants of each floor configured to calculate density, which is a number of people per area of the occupants of each floor, and to perform grouping so that the density of the occupants corresponds to the number of accommodable people at an evacuation safe floor;

an evacuation safe area analyzing part configured to analyze the number of accommodable people and an area of an evacuation safe area; and an evacuation safe area accommodation determining part configured to determine whether the evacuation safe area is sufficient so that all the grouped occupants evacuate.

5. The evacuation strategy support system using the occupant evacuation elevator of claim 1, wherein the evacuation capacity calculating part includes:

an occupant evacuation elevator operation determining part configured to calculate an operating time of the occupant evacuation elevator of the evacuation safe area and determine whether the occupant evacuation elevator is operable;

an evacuation capacity review part of the evacuation safe area configured to review the overload of the evacuation capacity at the evacuation safe area and whether the readjustment and the redesign are necessary in response to the occupant evacuation elevator being operable;

an evacuation capacity distribution determining part configured to determine whether the evacuation capacity according to the selection of the evacuation path of the grouped occupants is distributable; and a final evacuation capacity calculating part configured to calculate the final evacuation capacity of the occupant evacuation elevator.

6. The evacuation strategy support system using the occupant evacuation elevator of claim 1, wherein the real-time distributed control system selectively extracts a disaster/catastrophe situation and corresponding information of the skyscraper to quickly share to a location at which information is necessary, as a cyber physical system (CPS) linked with the evacuation capacity calculating part to provide evacuation situation information.

7. An evacuation strategy support method using an occupant evacuation elevator (OEE) to evacuate in a disaster situation which occurs in a skyscraper, comprising:

a) collecting occupant information on a number of occupants on each floor of the skyscraper and storing the occupant information on the number of occupants on each floor in a database;

b) calculating density of the occupants of each floor to perform grouping;

c) analyzing a number of accommodable people and an area of an evacuation safe area;

d) determining whether the evacuation safe area is sufficient so that all the grouped occupants evacuate;

e) analyzing and inputting a specification of the occupant evacuation elevator in response to the grouped occupants being accommodable in the evacuation safe area;

f) determining whether the occupant evacuation elevator of the evacuation safe area is operable;

g) reviewing an overload of an evacuation capacity at the evacuation safe area and whether a readjustment and a redesign are necessary in response to the occupant evacuation elevator being operable;

h) determining whether the evacuation capacity according to a selection of an evacuation path of the grouped occupants is distributable;

i) calculating a final evacuation capacity of the occupant evacuation elevator; and j) providing occupant evacuation information linked with a real-time distributed control system to correspond to the calculated evacuation capacity of the occupant evacuation elevator, wherein evacuation capacity calculation of the occupant evacuation elevator applicable to an initial stage of a design of the skyscraper is optimized.

8. The evacuation strategy support method using the occupant evacuation elevator of claim 7, wherein the database in the operation a) stores the collected occupant information on the number of occupants, and stores occupant evacuation elevator specification data, operating time data according to a general operation method, and National Fire Protection Association (NEPA) data.

9. The evacuation strategy support method using the occupant evacuation elevator of claim 7, wherein:

the specification of the occupant evacuation elevator in the operation e) includes an elevator capacity, the number of operable elevators, and an operating velocity which are specifications related to an operation of the occupant evacuation elevator; and an operation method of the occupant evacuation elevator is reviewed and input in the operation e).

10. The evacuation strategy support method using the occupant evacuation elevator of claim 7, wherein, in response to the evacuation safe area being not sufficient in the operation d), a number of all grouped occupants is determined to exceed the number of accommodable people and the area of the evacuation safe area.

* * * * *